US007909235B2

(12) United States Patent
Holley, Jr.

(10) Patent No.: US 7,909,235 B2
(45) Date of Patent: Mar. 22, 2011

(54) CARTON WITH DISPENSER

(75) Inventor: John Murdock Holley, Jr., Lawrenceville, GA (US)

(73) Assignee: Mead Westvaco Packaging Systems, LLC, Glen Allen, VA (US)

( * ) Notice: Subject to any disclaimer, the term of this patent is extended or adjusted under 35 U.S.C. 154(b) by 916 days.

(21) Appl. No.: 11/351,000

(22) Filed: Feb. 9, 2006

(65) Prior Publication Data

US 2006/0175386 A1 Aug. 10, 2006

Related U.S. Application Data

(60) Provisional application No. 60/651,156, filed on Feb. 9, 2005.

(51) Int. Cl.
*B65D 17/28* (2006.01)
*B65D 5/462* (2006.01)

(52) U.S. Cl. ..... 229/122; 229/117.13; 229/160.2; 229/240; 229/242

(58) Field of Classification Search ..... 229/117.12, 229/117.13, 117.14, 122, 160.2, 240, 122.1, 229/242; 206/427; 221/302–305
See application file for complete search history.

(56) References Cited

U.S. PATENT DOCUMENTS

| | | | | |
|---|---|---|---|---|
| 3,346,167 | A * | 10/1967 | Schmidt | 206/427 |
| 3,416,719 | A | 12/1968 | Pilger | |
| 3,904,036 | A | 9/1975 | Forrer | |
| 4,222,485 | A | 9/1980 | Focke | |
| 4,313,556 | A | 2/1982 | Boyle et al. | |
| 4,318,474 | A * | 3/1982 | Hasegawa | 229/242 |
| 4,375,258 | A | 3/1983 | Crayne et al. | |
| 4,946,042 | A * | 8/1990 | Ferreri et al. | 229/242 |
| 5,333,734 | A | 8/1994 | Stout et al. | |
| 5,622,309 | A * | 4/1997 | Matsuda et al. | 229/122 |
| 6,129,266 | A | 10/2000 | Oliff et al. | |
| 6,209,786 | B1 * | 4/2001 | Yelton et al. | 229/240 |
| 6,425,520 | B1 | 7/2002 | Peterson | |
| 6,484,903 | B2 | 11/2002 | Spivey et al. | |
| 6,866,186 | B2 * | 3/2005 | Fogle et al. | 229/117.13 |
| 7,100,798 | B2 * | 9/2006 | Spivey | 221/305 |
| 7,134,551 | B2 * | 11/2006 | Harrelson | 206/427 |
| 7,147,143 | B2 * | 12/2006 | Cargile | 229/122 |
| 2003/0141313 | A1 | 7/2003 | Bates | |
| 2004/0089671 | A1 * | 5/2004 | Miller | 221/305 |
| 2006/0091101 | A1 | 5/2006 | DeBusk | |
| 2006/0108406 | A1 * | 5/2006 | Stewart et al. | 229/122.1 |
| 2006/0254942 | A1 | 11/2006 | Cargile | |

FOREIGN PATENT DOCUMENTS

| | | | |
|---|---|---|---|
| DE | 10 2004 006899 | A1 | 11/2004 |
| WO | WO 02/30785 | A1 | 4/2002 |

* cited by examiner

*Primary Examiner* — Gary E Elkins
(74) *Attorney, Agent, or Firm* — Tsugihiko Suzuki

(57) ABSTRACT

A carton for containing a plurality of articles such as cans, the carton comprises a pair of side walls, a bottom wall, a top wall and end closure panels for at least partially closing the ends of the carton, wherein the top wall is of multi-ply construction and the carton further comprises an access means defined by a series of weakened lines in the top, side and end walls, the access means including at least one initiating means formed in the top wall, each initiating means including a pair of weakened lines which form a displaceable tab and each initiating means being of single-ply construction to facilitate easy opening of the carton access means.

16 Claims, 8 Drawing Sheets

CARTON WITH DISPENSER

This application claims priority to U.S. Provisional Application No. 60/651,156, filed Feb. 9, 2005, the entirety of which is incorporated herein by reference.

TECHNICAL FIELD OF THE INVENTION

The invention relates to cartons, and more particularly, to a carton for multiple articles having a dispenser having an easy opening feature.

BACKGROUND OF THE INVENTION

Cartons for encasing multiple articles are useful for enabling consumers to obtain and transport a desired quantity of individual articles such as soft drinks or other beverages. When such a multiple-pack of articles is obtained, a consumer frequently desires to remove one article from the carton at a time and store the remaining articles in the carton. Thus, it can be appreciated that it would be desirable to have a carton with a dispenser that enables the removal of articles from the carton.

When the articles in the carton are cylindrical, and are disposed in the carton upon their sides so that they can roll, it is important that the articles be constrained such that the remaining articles do not roll out of the dispenser when one article is removed. It is also important that the dispenser provides an arrangement in which the articles are easily accessed. It is further often desirable when removing individual articles from a carton to be able to determine how many articles remain in the carton. Thus, it can be further appreciated that it would be desirable to have a carton with a dispenser that constrains remaining articles so that they do not undesirably roll from or otherwise exit the carton when one article is removed. It can also be appreciated that it would be desirable to have a carton with a dispenser that facilitates access to the articles. It can be still further appreciated that it would be desirable to be able to determine how many articles remain in a carton from which individual articles are removed. Since the cartons are used for containing a plurality of articles it is often desirable for a carrying handle to be provided. Such a handle is required to be sufficiently strong to lift the carton which may contain many cans or bottles.

A carton having a dispenser is disclosed in U.S. Pat. No. 6,484,903. The carton has a detachable trough defined by an endless weakened line formed in the top, end and side walls of the carton. The weakened line in the top wall extends across an overlap of two top panels. The dispenser can therefore be difficult to open since the user has to break through two plies of material to break the weakened line defining the dispenser. Such cartons can therefore be difficult to open and may also not be readily adaptable for containing more than two tiers or articles.

A carton comprising a dispenser and containing three tiers of articles is disclosed in U.S. Pat. No. 3,416,719, the opening disclosed by the carton extends up from a bottom wall and retaining tabs at the front of the carton prevent the articles from being undesirably dislodged. This causes the carton to be inefficient because it requires the consumer to lift the article up over the retaining tabs against downward force of the articles resting on top of it.

It is therefore an objective of the present invention to provide a carton and blank for forming the carton, that overcomes or at least reduces the problems of the abovementioned prior art.

SUMMARY OF THE INVENTION

A carton of the invention has a reinforced top wall and a dispenser for articles. The dispenser can be substantially detached or torn away from the upper corner of the carton to expose an endmost article for removal.

The invention provides a carton for cylindrical articles, such as cans, comprising a generally tubular structure formed from a top wall, a bottom wall, and a pair of side walls connecting together the top and bottom wall, the carton further comprising an end wall at each end of the carton which at least partially closes the ends of the tubular structure to secure the articles therein, the articles being arranged in at least two rows with one row of articles being in rolling contact with the bottom wall of the carton and the ends of all the articles being in abutment with respective ones of the side walls of the carton, at least one end of the carton having access means to allow removal of the carton contents, the access means being defined by a series of weakened lines in the top, side and end wall characterized in that the access means comprises initiating means to disrupt the top wall to deploy the access means, the top wall having both multi-ply and single ply areas and the initiating means being disposed in a single-ply area of the top wall thereby facilitating deployment of the access means. Preferably, each initiating means is defined by a pair of cooperative weakened lines which together form a displaceable tab.

According to a feature of the invention, the multi-ply top wall may be formed from two partially overlapping top wall panels, an initiating means being formed in each of the top panels and in regions where the top panels do not overlap. Preferably, the multi-ply top wall further comprises a reinforcing flap secured to one of said overlapping top wall panels and shaped correspondingly to the contour of the initiating means. It is also preferred that the multi-ply top wall further comprising a pair of hand apertures struck from each ply, each pair of hand apertures being aligned such that a reinforced carrying means is formed in the carton top wall.

According to another feature of the invention, the end wall may comprise at least one top end flap, the top end flap being hinged to a top wall panel adjacent a portion of the top wall panel in which an initiating means is defined. Preferably, the weakened lines defining the access means are disposed in the side walls and extend between said top wall and said end wall, said lines being curved concavely toward said end wall to partially expose opposite ends of the end most cans when said displaceable portion is detached from the carton. Preferably, the end wall comprises a pair of overlapping side end flaps and wherein weakened lines of the access means extend between the side walls of the carton entirely across the side end flaps thereby defining a retaining portion of the end wall.

BRIEF DESCRIPTION OF THE DRAWINGS

Exemplary embodiments of the invention will now be described by way of example only with reference to the accompanying drawings in which.

DETAILED DESCRIPTION OF THE PREFERRED EMBODIMENTS

Figure 1:
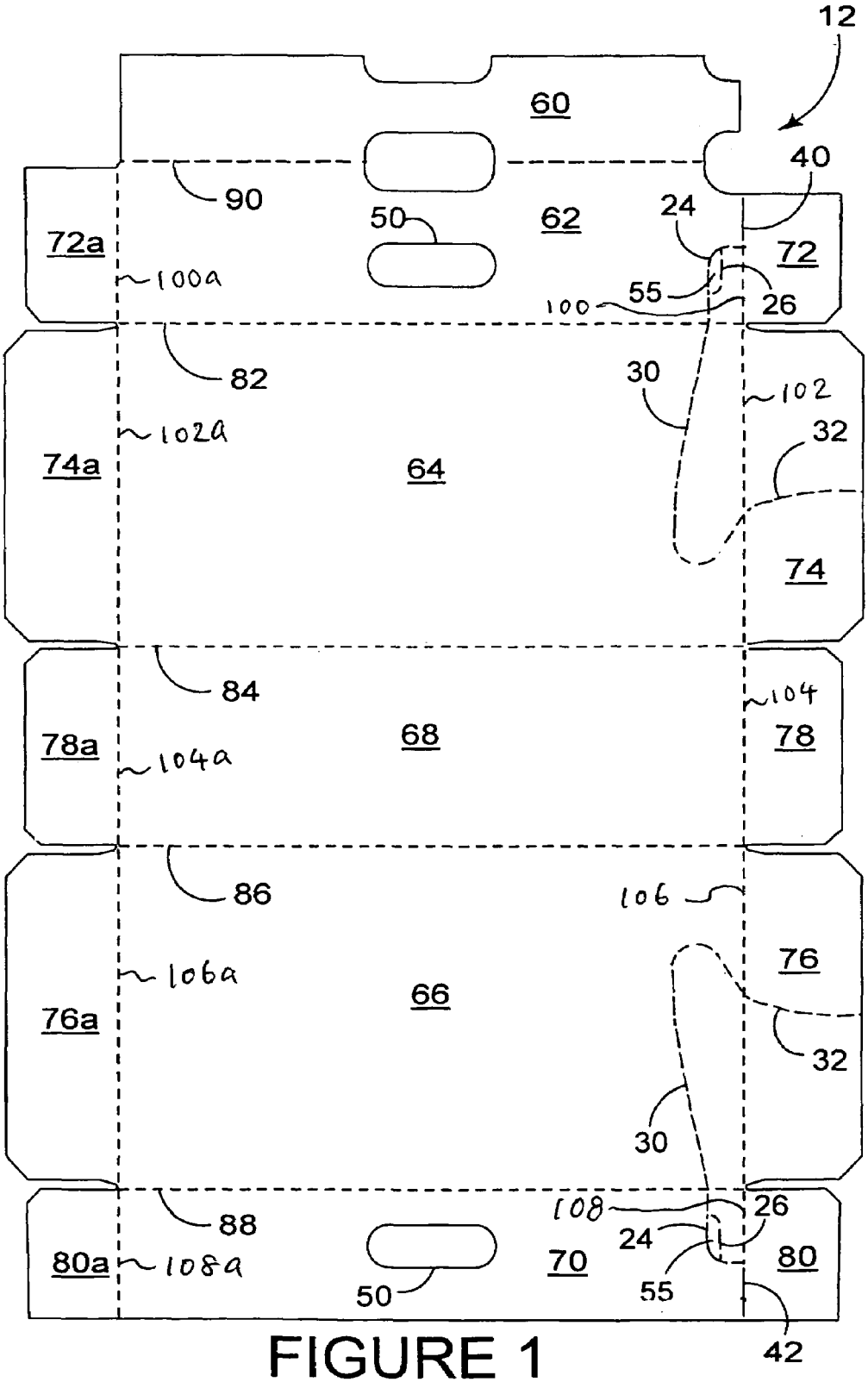
FIG. 1 is a plan view of a blank for forming a carton for containing cans.

FIGS. 1 to 6 illustrate a first embodiment of the present invention. Throughout these drawings, the same reference numerals are used to denote the same or like features of the invention.

Figure 3:
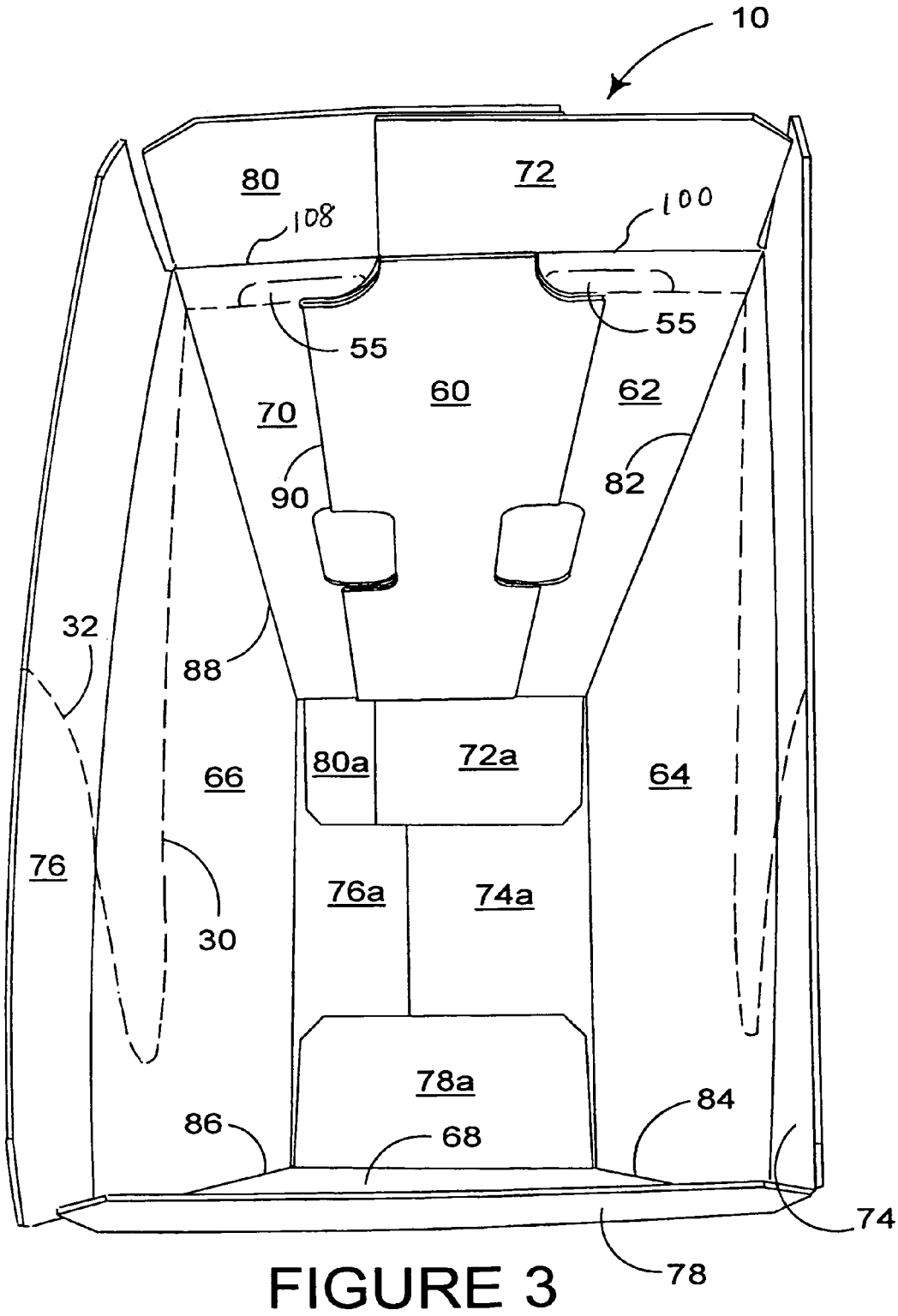
FIG. 3 is a perspective view from one end, looking into the carton of FIG. 2.
Figure 4:
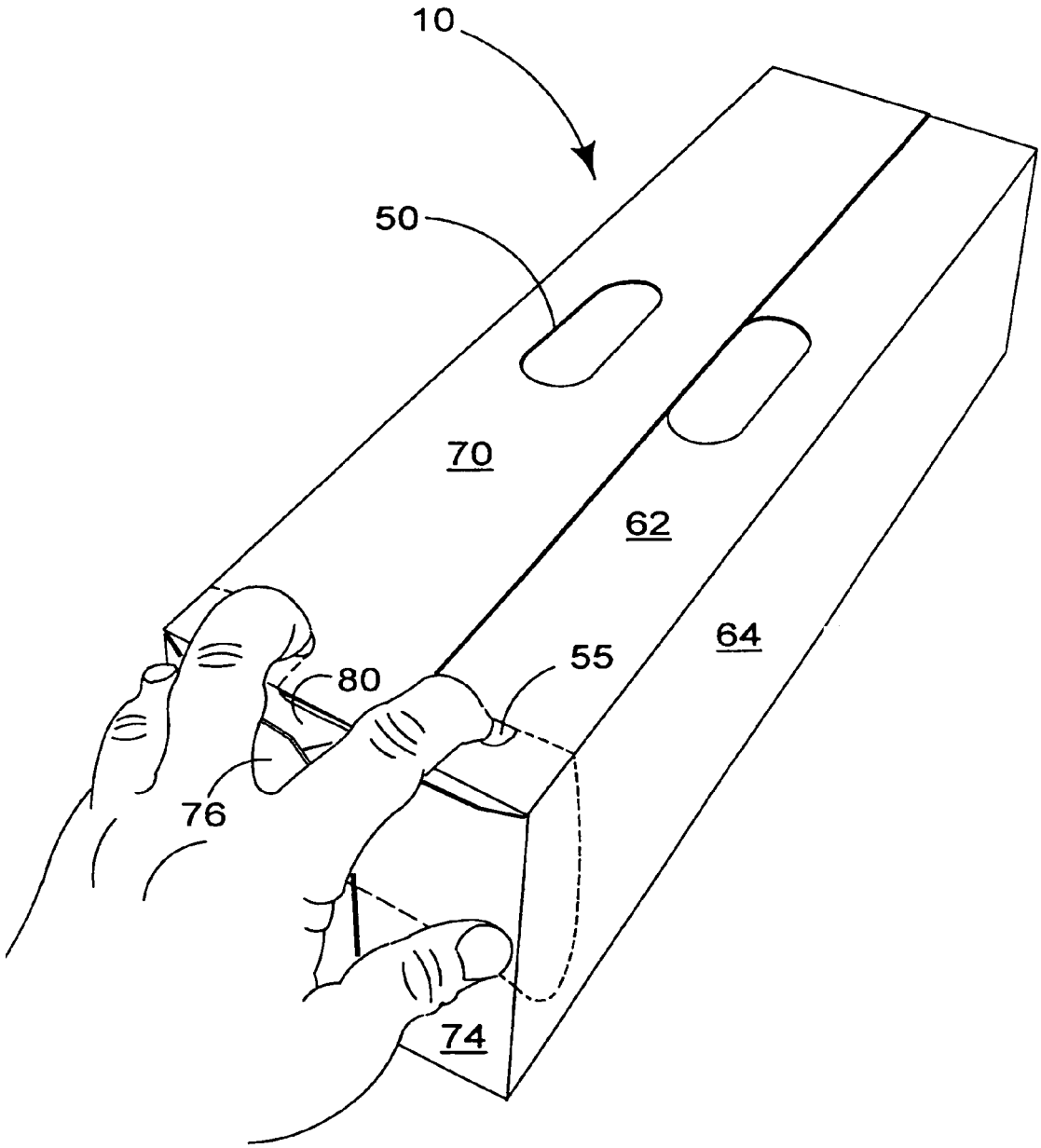
FIG. 4 is an isometric illustration of the carton of FIG. 2 with the access means engaged by a user's hand to initiate opening of the carton.
Figure 5:
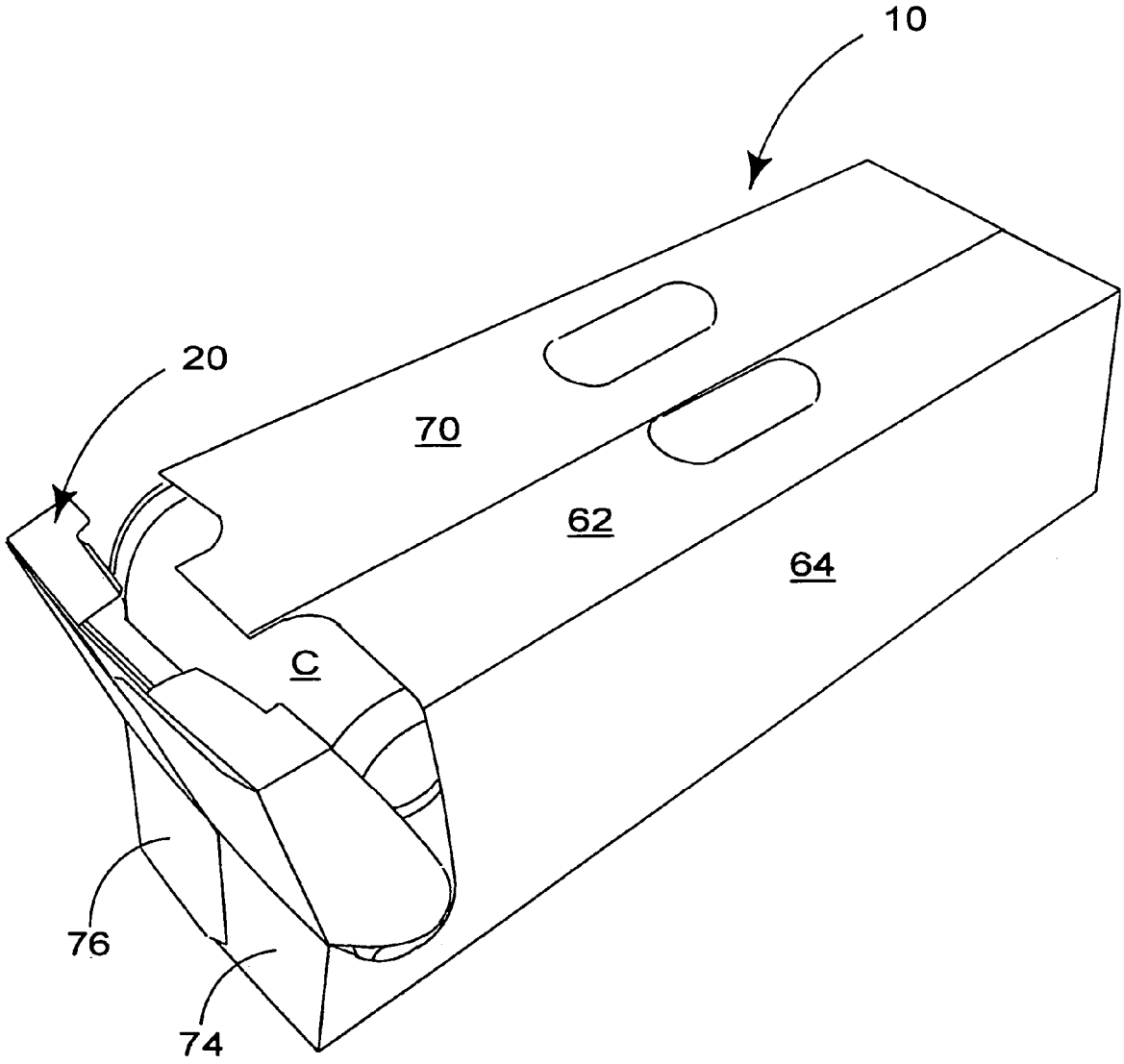
FIG. 5 is an isometric illustration of the carton of FIG. 4 with the access means pivoted away from the end of the carton.
Figure 6:
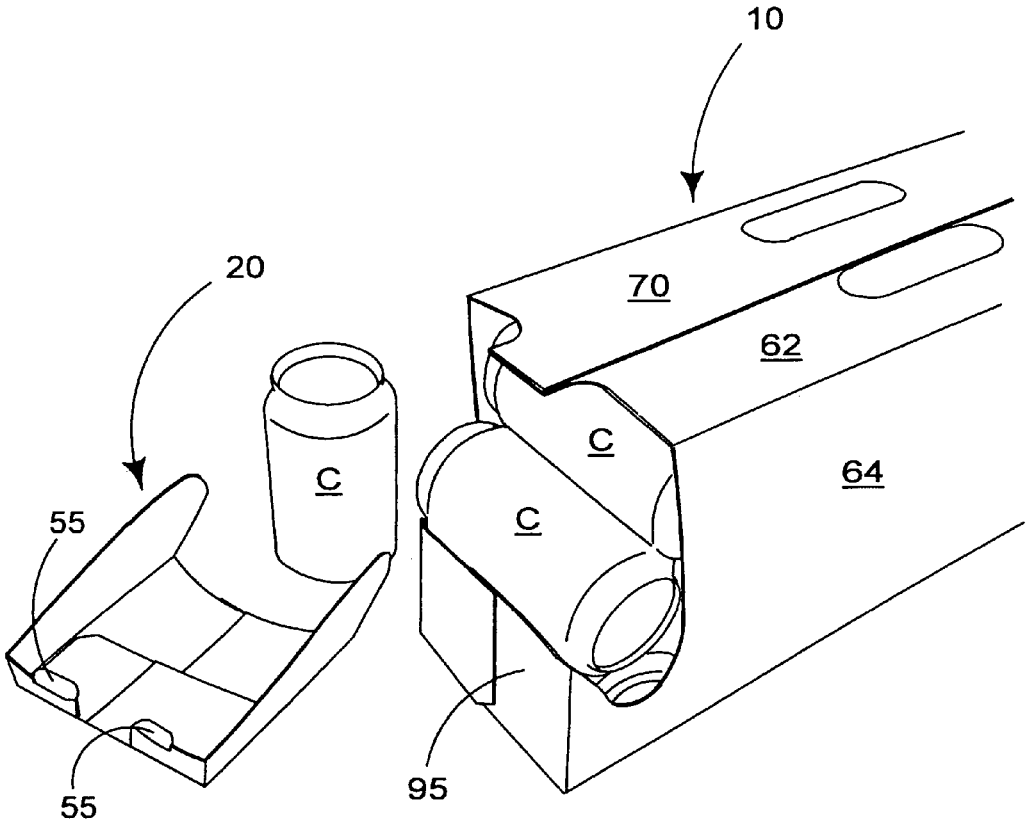
FIG. 6 is an isometric illustration of the carton of FIG. 5 with the access means completely detached from the carton.

FIG. 1 illustrates a blank 12 from which the carton of FIGS. 2-6 is formed. The blank 12 is vertically elongate as viewed in FIG. 1 and is formed, in this embodiment, of paperboard. However the blank maybe formed of other foldable material such as a plastic sheet or the like. Cans "C" arranged in a 6×3 array are shown in FIGS. 5 and 6 as an aid in understanding the invention. More specifically, the cans "C" are arranged in a group consisting of three vertically disposed tiers each including six cans. The cans "C" in each tier are disposed on their sides in a side-by-side parallel fashion and in rolling contact with a bottom wall panel 68 of the carton 10.

Referring to FIG. 1, the blank 12 includes four primary panels for forming the carton walls, i.e., a first side wall panel 64, a first top wall panel 62, the bottom wall panel 68, a second side wall panel 66 and a second top wall panel 70. The primary panels are hinged one to the next along fold lines 82, 84, 86 and 88. A reinforcing flap 60 is hinged to the first top panel 62 along a weakened fold line 90. The first and second top wall panels 62, 70 are each provided with hand apertures 50 which can be employed by a user to lift the carton 10. The reinforcing flap 60 is shaped in a complementary manner so that upon construction of the carton 10, edges of the reinforcing flap 60 align with the hand apertures 50 formed in each of the two top wall panels 62 and 70.

Reference numerals 72, 72*a*, 74, 74*a*, 78, 78*a*, 76, 76*a*, 80, 80*a* designate end flaps hinged to the ends of the primary panels 62, 64, 68, 66. More particularly, the end flaps 72, 72*a* are hingedly connected to the top wall panel 62 along fold lines 100, 100*a* respectively. The end flaps 74, 74*a* are hingedly connected to the side wall panel 64 along fold lines 102, 102*a* respectively. The end flaps 78, 78*a* are hingedly connected to the bottom wall panel 68 along fold lines 104, 104*a* respectively. The end flaps 76, 76*a* are hingedly connected to the side wall panel 66 along fold lines 106, 106*a* respectively. The end flaps 80, 80*a* are hingedly connected to the top wall panel 70 along fold lines 108, 108*a* respectively. The end flaps 72, 74, 78, 76 and 80 arranged along one (100, 102, 104, 106, 108) of the opposed longitudinal edges of the blank 12 form a composite end wall as shown at 91 in FIG. 2, when the blank 12 is erected into a carton 10. In like manner, the end flaps 72*a*, 74*a*, 78*a*, 76*a* and 80*a* arranged along the other longitudinal edge (100*a*, 102*a*, 104*a*, 106*a*, 108*a*) of the blank 12 form another composite end wall at the other end of the carton, when the blank 12 is erected into a carton 10. The end flaps 72 and 80 are hingedly connected respectively to the first and second top wall panels 62 and 70 along the fold lines 100, 108 each of which is formed in part of a tear line 40, 42 as best shown in FIG. 1. The tear lines 40, 42 are disposed in alignment, and extend coincidentally, with each other when the blank 12 is erected into the carton 10.

A series of weakened lines of severance 24, 26, 30, 32 are provided in the first and second top wall panels 62, 70, the first and second side wall panels 64, 66 and the side end flaps 74, 76 respectively. The weakened lines of severance 24, 26, 30, 32 together with the tear lines 40, 42 define an access means 20. The weakened lines of severance 24, 26 provided in the first and second top wall panels 62, 70 also define finger tabs 55. The finger tabs 55 are shaped and structured to yield upon the application of pressure, thereby assisting a user of the carton with engaging the access means 20 thereby enabling the end of the carton 10 to be opened and thus enabling access to be gained to the cans 'C' contained within the carton 10.

Turning to the construction of the carton 10, a series of folding and gluing steps are required, which preferably can be performed in a straight line machine, so that the carton 10 and/or blank 12 are not required to be rotated or inverted to complete the construction. The folding process is not limited to that described below and can be altered according to particular manufacturing requirements.

To form an erected carton from the blank 12, glue or other adhesive is first applied to an inside face of the reinforcing flap 60 which is then folded along the weakened fold line 90 to lie in flat face contact with an inside face of to the first top wall panel 62. The blank 12 is folded about fold line 86, so that the inside face of the first side panel 64 contacts both the inside face of the bottom wall panel 68 and in part the second side wall panel 66. Glue is applied to the inside face of the second top wall panel 70 which is then folded about the fold line 88 to lie flat on the first top wall panel 62 and secured therewith. The outside face of the first top wall panel 62 may in part be varnish free so that the second top wall panel 70 can be secured by means of glue to the first top wall panel 62. In this way a three ply composite top wall is formed and a flat tubular carton can be provided to a manufacturing plant for further processing.

The flat tubular carton is then expanded into an open-ended tubular form. After cans are loaded through one or both of the open ends of the carton 10, the end flaps 72, 72*a*, 74, 74*a*, 76, 76*a*, 78, 78*a*, 80, 80*a* are folded to form the respective end walls to thereby close the ends of the carton. To form the end wall 90, the top and bottom end flaps 72/80 and 78 are folded to their respective vertical positions. Glue is applied to the outside faces of the end flaps 72/80 and 78, and then the side end flaps 74 and 76 are folded in the described sequence onto the top and bottom end flaps 72/80 and 74. This causes the side end flaps 74 and 76 to be glued to the top and bottom end flaps 72/80 and 74. This causes the side end flaps 74 and 76 to be glued to the top and bottom end flaps 72/80 and 74. In the closed position shown in FIG. 2, the side end flaps 76 and 78 overlap each other and are secured together also by means of glue. The other end wall of the carton is formed in like manner by end flaps 72*a*, 74*a*, 76*a*, 78*a* and 80*a* and is illustrated, from the inside of the carton in FIG. 3.

Also shown in FIG. 3 is an underside view of the composite top wall, with the reinforcing flap 60 secured to the first top wall panel 62, which is in turn secured to the second top wall panel 70. The complementary shape of the reinforcing flap 60 can also be seen in FIG. 3. One end of the reinforcing flap 60 is contoured to match the path of the weakened lines of severance 24 which are formed in each of the first and second top wall panels 62 and 70. In other embodiments it is envisaged that the shape of the reinforcing flap 60 may differ in accordance with the contour marked by the weakened lines of severance 24. The shape and arrangement of the reinforcing flap 60 and first and second top wall panels 62, 70 provides a strong reinforced composite top wall from which the access means 20 can be easily detached or displaced.

Figure 2:
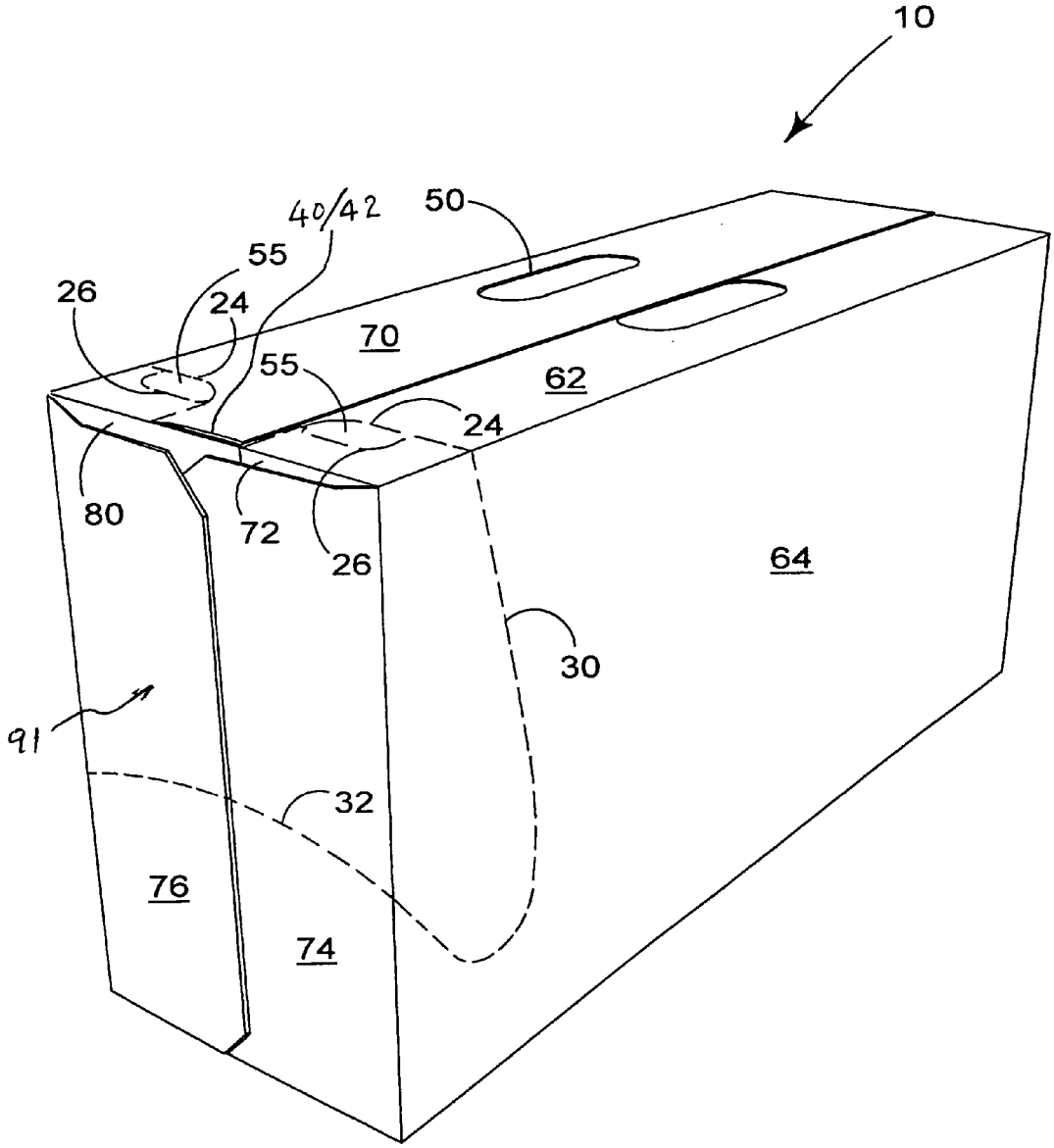
FIG. 2 is an isometric illustration of the carton having a dispenser or access means in accordance with a preferred embodiment of the invention, formed from the blank of FIG. 1.

An erected carton is shown in FIG. 2 wherein the access means 20 is integrally formed to be displaceable and/or fully detachable to allow access to the cans 'C' held within the carton 10. FIG. 4 illustrates how the finger tabs 55 provide a means of easily initiating the tearing of the weakened lines of severance 30, which extend from the first and second top wall panels 62, 70 into each of the first and second side wall panels 66, 64. By applying pressure to the finger tabs 55, one or each of the weakened lines of severance 24, 26, which define the finger tabs 55, may become separated from the carton 12, thereby creating a void or gap in which a user's fingers may be inserted. The user can then readily engage the access means 20 to displace or fully detach the access means 20 from the carton 12, as shown in FIGS. 5 and 6.

The arrangement and shape of the reinforcing flap, finger tabs 55 and tear lines 40, 42 provides an access means 20 being separable from the composite top wall of the carton 12 by tearing through only one or two plies of material, despite the top wall comprising three layers of paper board. The arrangement of the present invention therefore provides an access means 20 which requires considerably less pressure and work to employ than if the weakened lines of severance extended fully across the composite top wall and therefore were necessarily provided in each layer or ply. The rigidity of the composite top wall also assists when the pressure is applied to the finger tabs 55 and the weakened lines of severance 24, 26 are broken, the rigid composite top wall does not give or flex inward as downward pressure is applied to the finger tabs, this contributes to the easy deployment of the access means 20.

In the preferred embodiment illustrated, the tear lines 30 are of arcuate configuration. They are curved or arched concavely toward the end wall 90. The tear lines 30 intersect a frangible or otherwise weakened line 32 that is formed in the side end flaps 76 and 78 to extend between the side walls 64 and 66 entirely across the end wall 90, thereby defining a retaining portion 95 of the end wall 90.

The tight packing of the carton 12 and/or the rigidity of the composite top wall provides tension in the carton walls which may restrain the cans 'C' of the uppermost row from rolling free from the carton 12 when the access means 20 is first displaced or detached from the carton 12. The protruding part of the composite top wall may also assist in retaining the end most can of the uppermost row within the carton 12 as the access means 20 is deployed. Furthermore, the configuration of the weakened lines 32 provides an opening which is shaped such that cans 'C' of the lowermost rows are restrained from rolling free from the carton 12 by the remaining portion 95 of the end wall 90. Access to the end most cans 'C' of the lower most rows is however readily accommodated by the shape of the weakened lines 30 in the side wall panels 64, 66, which partially exposes the ends of said cans 'C' as shown in FIG. 6, so that a user can easily grasp an endmost can 'C' between a first finger and thumb for removal from the carton 12. The curvature of the tear lines 30 helps to increase the exposed areas of the can ends. After the top, end-most can is removed from the upper tier, the remaining cans 'C' in the upper tier will nest in the spaces between the cans of the lower tier. Nesting of cans in this manner is well known in the art and is not illustrated. The invention serves as a useful dispensing carton that can be placed upon a surface or within a compartment such as a refrigerator or pantry.

Figure 7:
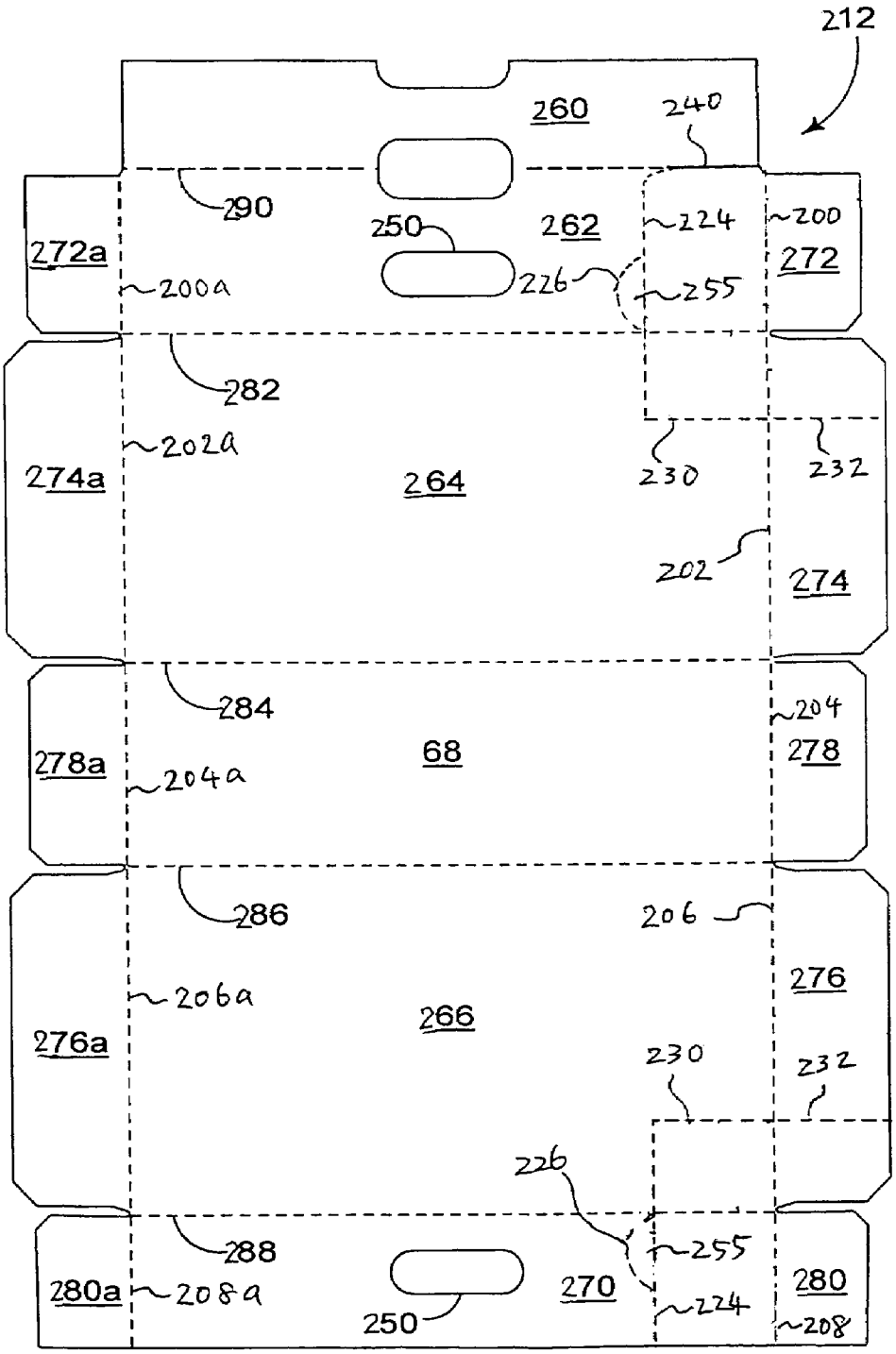
FIG. 7 is a plan view of a blank for forming a carton of the second embodiment according to the invention.
Figure 8:
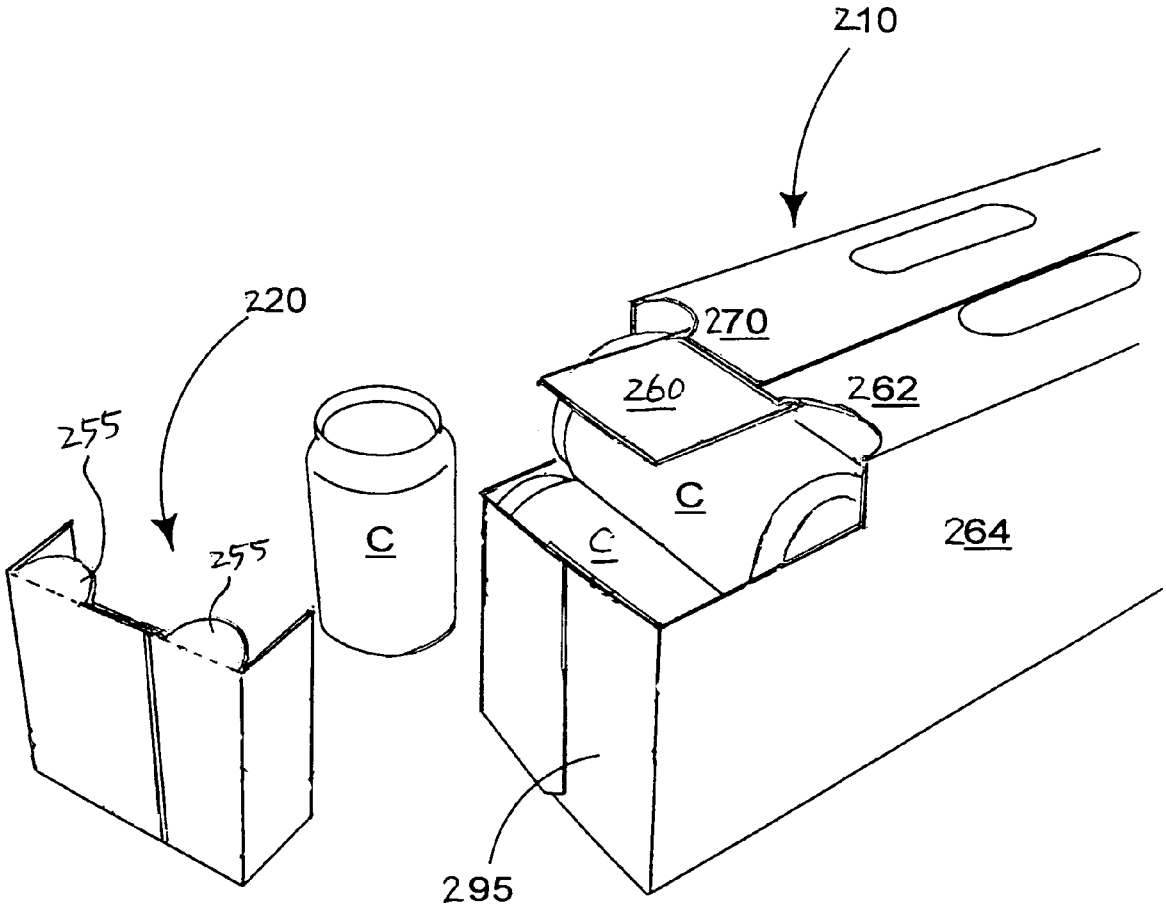
FIG. 8 is an isometric illustration of a carton formed from the blank of FIG. 7, with the access means completely detached from the carton.

FIGS. 7 and 8 illustrate a second embodiment of the present invention. The blank 212 and the carton 210 of the second embodiment are similar to the first embodiment and therefore like portions are designated by the same reference numeral but are prefixed with the numeral "2". Therefore only the differences are described in any greater detail.

A series of weakened lines of severance 224, 226, 230, 232 are provided in the first and second top wall panels 262, 270, the first and second side wall panels 264, 266 and the side end flaps 274, 276 respectively. These weakened lines of severance 224, 226, 230, 232 together with the tear lines 240 together form a severable connection that defines an access means 220. The weakened lines of severance 224, 226 provided in the first and second top wall panels 262, 270 also define finger tabs 255. The finger tabs 255 are shaped and structured to yield upon the application of pressure.

A folding process similar to that for the first embodiment is used to assemble the carton 210 of the second embodiment. When the carton 210 is erected, the weakened lines 224, 224 of severance in the top wall panels 262, 270 are aligned, and extend partially coincidentally, with each other to allow the part of the severance connection in the top wall to extend entirely across the two ply area of the top wall. The handle reinforcing strip or flap 260 is free of weakened line. However, the tear line 240 that is aligned, and extends coincidentally, with the fold line 290 is disposed continuous with the weakened line 224 of severance in the top wall panel 262 to assist easy separation of the access means 220 from the remainder of the carton 210.

To open the carton 210, the initiating means in the form of finger tabs 255, 255 are pressed by fingers to break the weakened lines 226, 226. Then, the access means 220 is pulled forwardly away from the remainder of the carton 210. By this means, the weakened lines 224, 224, 230, 230 are broken and the access means 220 is pivoted forwardly and downwardly about the weakened lines 232, 232. Further pivoting the access means 220 allows the tear line 240 to break as well as the top wall panel 262 to be peeled and detached from the reinforcing flap 260. Finally, the access means 220 are severed from the carton 210 along the weakened lines 232, 232. A fully opened carton 210 is illustrated in FIG. 8 along with the completely separated access means 220. As apparent from FIG. 8, the forward end portion of the reinforcing flap 260 protrudes from the severed forward edge of the top wall 262, 270 and serves to hold down the cans C to prevent undesired exit of the cans from the carton. The reinforcing flap 260, however, is flexible and easily yieldable when one or more cans are pulled out by a user through the gap between the end wall 295 and the reinforcing flap 260.

Modifications may be made in the foregoing without departing from the scope of the claimed invention. For example, the access means may be formed at each end of the carton according to the invention and in other embodiments it is envisaged that the tear lines 40, 42 may be perforated lines, slits or cuts. It should be also appreciated that as used herein, directional references such as "top", "bottom", "end", "side", "upper" and "lower" do not limit the respective panels to such orientation, but merely serve to distinguish these panels from one another.

It should be further appreciated that any reference to hinged or foldable connection should not be construed as necessarily referring to a single fold line only: indeed, it is envisaged that hinged connection can be formed from one or more of one of the following, a score line, a frangible line or a fold line, without departing from the scope of invention. It should be further appreciated that each of the weakened lines of severance and the tear lines as referred to in this application may comprise a cut line or frangible line that includes, but is not limited to, a line of perforations, a line of short slits, a line of half cuts, a single half cut, any combination of slits, score lines, and half cuts, or the equivalent, as will be understood by those skilled in the art. It should be further appreciated that each of the fold lines as referred to in this application may comprise a frangible line that includes, but is not limited to, a score line, a line of perforations, a line of short slits, a line of half cuts, any combination of slits, score lines, and half cuts, or the equivalent, as will be understood by those skilled in the art.

What is claimed is:

1. A carton for cylindrical articles, comprising a generally tubular structure formed from a top wall, a bottom wall, and a pair of side walls connecting together the top and bottom wall, the carton further comprising an end wall at each end of the carton which at least partially closes the ends of the tubular structure to secure the articles therein, at least one end of the carton having access means to allow removal of the articles, the access means being defined by a severable connection comprising a series of weakened lines which are disposed at least in the top wall and one of the end walls, wherein the access means comprises initiating means to disrupt the top wall to deploy the access means, the top wall having both multi-ply and single ply areas and the initiating means being disposed at least in part in a single-ply area of the top wall thereby facilitating deployment of the access means, at least part of the severable connection is disposed in alignment, and extends coincidentally, with a hinged connection that hingedly connects between the top wall and an adjacent portion of the carton, wherein said adjacent portion comprises an end flap that is hingedly connected to the top wall along said hinged connection.

2. A carton according to claim 1 wherein said adjacent portion comprises a reinforcing flap that is hingedly connected to the top wall along said hinged connection.

3. A carton according to claim 1 wherein the initiating means is defined by a pair of cooperative weakened lines which together form a displaceable tab.

4. A carton according to claim 1 wherein the top wall is formed from two partially overlapping top wall panels providing the multi-ply area.

5. A carton according to claim 1 wherein the articles are arranged in at least two rows with one row of articles being in rolling contact with the bottom wall and the ends of all the articles are in abutment with respective ones of the side walls.

6. A carton for cylindrical articles, comprising a generally tubular structure formed from a top wall, a bottom wall, and a pair of side walls connecting together the top and bottom wall, the carton further comprising an end wall at each end of the carton which at least partially closes the ends of the tubular structure to secure the articles therein, at least one end of the carton having access means to allow removal of the articles, the access means being defined by a severable connection comprising a series of weakened lines which are disposed at least in the top wall and one of the end walls, wherein the access means comprises initiating means to disrupt the top wall to deploy the access means, the top wall having both multi-ply and single ply areas and the initiating means being disposed at least in part in a single-ply area of the top wall thereby facilitating deployment of the access means, at least part of the severable connection is disposed in alignment, and extends coincidentally, with a hinged connection that hingedly connects between the top wall and an adjacent portion of the carton wherein the top wall is formed from two partially overlapping top wall panels providing the multi-ply area, and wherein the initiating means is formed at least in part in each of the top wall panels within the respective single-ply area.

7. A carton for cylindrical articles, comprising a generally tubular structure formed from a top wall, a bottom wall, and a pair of side walls connecting together the top and bottom wall, the carton further comprising an end wall at each end of the carton which at least partially closes the ends of the tubular structure to secure the articles therein, at least one end of the carton having access means to allow removal of the articles, the access means being defined by a severable connection comprising a series of weakened lines which are disposed at least in the top wall and one of the end walls, wherein the access means comprises initiating means to disrupt the top wall to deploy the access means, the top wall having both multi-ply and single ply areas and the initiating means being disposed at least in part in a single-ply area of the top wall thereby facilitating deployment of the access means, at least part of the severable connection is disposed in alignment, and extends coincidentally, with a hinged connection that hingedly connects between the top wall and an adjacent portion of the carton, wherein the top wall is formed from two partially overlapping top wall panels providing the multi-ply area, and wherein the top wall further comprises a reinforcing flap secured to one of said top wall panels, and the reinforcing panel comprises said adjacent portion.

8. A carton according to claim 7 wherein said reinforcing flap is shaped correspondingly, at least in part, to the initiating means to avoid overlapping with the initiating means.

9. A carton according to claim 7 wherein said reinforcing flap comprises a handle reinforcing strip secured to an inside surface of said one of said top wall panels.

10. A carton for cylindrical articles, comprising a generally tubular structure formed from a top wall, a bottom wall, and a pair of side walls connecting together the top and bottom wall, the carton further comprising an end wall at each end of the carton which at least partially closes the ends of the tubular structure to secure the articles therein, at least one end of the carton having access means to allow removal of the articles, the access means being defined by a severable connection comprising a series of weakened lines which are disposed at least in the top wall and one of the end walls, wherein the access means comprises initiating means to disrupt the top wall to deploy the access means, the top wall having both multi-ply and single ply areas and the initiating means being disposed at least in part in a single-ply area of the top wall thereby facilitating deployment of the access means, at least part of the severable connection is disposed in alignment, and extends coincidentally, with a hinged connection that hingedly connects between the top wall and an adjacent portion of the carton, wherein the top wall is formed from two partially overlapping top wall panels providing the multi-ply area, and wherein the top wall includes a pair of hand apertures, at least one of the hand apertures being defined within one of the single-ply areas such that a reinforced carrying means is formed at least in part from the multi-ply area.

11. A carton for cylindrical articles, comprising a generally tubular structure formed from a top wall, a bottom wall, and a pair of side walls connecting together the top and bottom wall, the carton further comprising an end wall at each end of the carton which at least partially closes the ends of the tubular structure to secure the articles therein, at least one end of the carton having access means to allow removal of the articles, the access means being defined by a severable connection comprising a series of weakened lines which are disposed at least in the top wall and one of the end walls, wherein the access means comprises initiating means to disrupt the top wall to deploy the access means, the top wall having both multi-ply and single ply areas and the initiating means being disposed at least in part in a single-ply area of the top wall thereby facilitating deployment of the access means, at least part of the severable connection is disposed in alignment, and extends coincidentally, with a hinged connection that hingedly connects between the top wall and an adjacent portion of the carton, wherein the top wall is formed from two partially overlapping top wall panels providing the multi-ply area, and wherein said at least one end wall comprises at least one top end flap, the one top end flap comprising said adjacent portion and being hingedly connected to one of the top wall panels.

12. A carton for cylindrical articles, comprising a generally tubular structure formed from a top wall, a bottom wall, and a pair of side walls connecting together the top and bottom wall, the carton further comprising an end wall at each end of the carton which at least partially closes the ends of the tubular structure to secure the articles therein, at least one end of the carton having access means to allow removal of the articles, the access means being defined by a severable connection comprising a series of weakened lines which are disposed at least in the top wall and one of the end walls, wherein the access means comprises initiating means to disrupt the top wall to deploy the access means, the top wall having both multi-ply and single ply areas and the initiating means being disposed at least in part in a single-ply area of the top wall thereby facilitating deployment of the access means, at least part of the severable connection is disposed in alignment, and extends coincidentally, with a hinged connection that hingedly connects between the to wall and an adjacent portion of the carton, and wherein said severable connection is disposed at least in part in the side walls, and said severable connection in said side walls extend between said top wall and said at least one end wall.

13. A carton according to claim 12 wherein said severable connection in said side walls is curved concavely toward said at least one end wall to partially expose opposite ends of an end most article when said access means is removed from the carton.

14. A carton for cylindrical articles, comprising a generally tubular structure formed from a top wall, a bottom wall, and a pair of side walls connecting together the top and bottom wall, the carton further comprising an end wall at each end of the carton which at least partially closes the ends of the tubular structure to secure the articles therein, at least one end of the carton having access means to allow removal of the articles, the access means being defined by a severable connection comprising a series of weakened lines which are disposed at least in the top wall and one of the end walls wherein the access means having both multi-ply and single-ply areas and the initiating means being disposed at least in part in a single-ply area of the top wall thereby facilitating deployment of the access means, at least part of the severable connection is disposed in alignment and extends coincidentally, with a hinged connection that hingedly connects between the top wall and an adjacent portion of the carton, and wherein said at least one end wall comprises a pair of overlapping side end flaps, and wherein said severable connection in the said at least one end wall extends between the side walls of the carton entirely across the side end flaps thereby defining a retaining portion of the end wall.

15. A carton for cylindrical articles, comprising a generally tubular structure formed from a top wall, a bottom wall, and a pair of side walls connecting together the top and bottom wall, the carton further comprising an end wall at each end of the carton which at least partially closes the ends of the tubular structure to secure the articles therein, at least one end of the carton having access means to allow removal of the articles, the access means being defined by a severable connection comprising a series of weakened lines which are disposed at least in the top wall and one of the end walls, wherein the access means comprises initiating means to disrupt the top wall to deploy the access means, the top wall having both multi-ply and single-ply areas and the initiating means being disposed at least in part in a single-ply area of the top wall thereby facilitating deployment of the access means, at least part of the severable connection is disposed in alignment, and extends coincidentally, with a hinged connection that hingedly connects between the top wall and an adjacent portion of the carton, wherein the top wall is formed from two partially overlapping top wall panels providing the multi-ply area, and wherein said at least one end wall comprises a pair of top end flaps, said top end flaps of the pair comprising said adjacent portion and being hingedly connected to said top wall panels along fold lines respectively.

16. A carton according to claim 15 wherein said fold lines are aligned, and extend coincidentally, with each other, and said hinged connection comprises said fold lines.

* * * * *